US005901401A

United States Patent [19]

Rutkowski et al.

[11] Patent Number: 5,901,401

[45] Date of Patent: May 11, 1999

[54] FEED CONTROL DEVICE FOR PLUMBING TOOLS

[75] Inventors: Michael J. Rutkowski, Brunswick; Jon R. Dunkin, Elyria, both of Ohio

[73] Assignee: Emerson Electric Company, St. Louis, Mo.

[21] Appl. No.: 08/901,653

[22] Filed: Jul. 28, 1997

[51] Int. Cl.[6] ..... B08B 1/00

[52] U.S. Cl. ..... 15/104.33; 15/104.31; 254/134.3 FT

[58] Field of Search ..... 15/104.33, 104.31, 15/104.095; 254/134.3 FT; 226/52

[56] References Cited

U.S. PATENT DOCUMENTS

| | | |
|---|---|---|
| 3,224,024 | 12/1965 | Hunt . |
| 3,449,782 | 6/1969 | Hunt . |
| 3,451,089 | 6/1969 | Carlson . |
| 3,691,583 | 9/1972 | Silverman . |
| 3,703,015 | 11/1972 | Naeve . |
| 3,882,565 | 5/1975 | Irwin . |
| 4,153,966 | 5/1979 | Irwin . |
| 4,218,802 | 8/1980 | Babb . |
| 4,580,306 | 4/1986 | Irwin . |
| 4,686,732 | 8/1987 | Irwin . |
| 4,956,889 | 9/1990 | Kirk . |
| 5,029,356 | 7/1991 | Silverman . |
| 5,031,263 | 7/1991 | Babb . |
| 5,239,724 | 8/1993 | Salecker . |
| 5,507,062 | 4/1996 | Salecker . |
| 5,640,736 | 6/1997 | Salecker ..... 15/104.33 |

*Primary Examiner*—Randall E. Chin
*Assistant Examiner*—Kaj Olsen
*Attorney, Agent, or Firm*—Vickers, Daniels & Young

[57] ABSTRACT

A feed control device particularly suited for mounting on a hand held, power driven drain cleaning apparatus having an elongate rotatable snake comprises a tubular housing having a transverse wall therein provided with a passage for the snake, a pair of driving rolls mounted on the wall for rotation about axes skewed relative to the housing axis and a drive actuating roll mounted on the housing for radial displacement to engage the rotating snake against the driving rolls. The actuating drive roll provides the inner end of an actuating drive unit having an outer end engaged by a pivotal lever on the housing for displacing the actuating drive roll against the snake. The actuating drive unit is adjustable in length between the inner and outer ends thereof and is removably supported on the housing, and the lever and outer end of the drive actuating unit interengage for the member to retain the parts of the actuating drive unit in an adjusted position and to releasably hold the drive actuating unit on the housing.

55 Claims, 6 Drawing Sheets

FEED CONTROL DEVICE FOR PLUMBING TOOLS

BACKGROUND OF THE INVENTION

This invention relates to the art of drain cleaning apparatus and, more particularly, to an improved feed control arrangement by which a flexible snake of such apparatus can be axially advanced and retracted relative thereto during a drain cleaning operation.

The present invention finds particular utility in connection with portable, motor driven flexible snake-type drain cleaning apparatus of the character in which the snake is rotated by a hand held, trigger actuated motor, such as shown for example in U.S. Pat. No. 4,956,889 to Kirk. The patent to Kirk is assigned to the same assignee as the present invention, and the disclosure thereof is incorporated herein by reference. While the invention will be described in detail hereinafter in conjunction with such hand held, motor driven drain cleaning apparatus, it will be appreciated that the invention is applicable to other power driven drain cleaning apparatus in which feed control arrangements are provided for axially advancing and retracting the snake during use of the apparatus.

The drain cleaning apparatus disclosed in the patent to Kirk is comprised of a hand held, trigger actuated motor drivingly connected to a snake housing for rotating the housing about a longitudinal axis. The housing is provided with a guide tube which opens thereinto coaxial with the axis, and a flexible snake is coiled within the housing and extends through the guide tube and, generally, is provided on its free end forwardly of the guide tube with a blade or other auger component. Often, the housing or a snake cartridge within the housing can be removed to facilitate connecting successive snakes for feeding into a waste line or for using different diameter snakes with the apparatus. The snake, as is conventional, is an elongate, flexible member made of tightly wound spring wire, and the free outer end thereof is adapted to be pulled from or pushed back into the housing in which the snake is stored during periods of non-use. A hand grip sleeve arrangement surrounds the guide tube and is rotatable and axially displaceable relative to the guide tube to effect the displacement of snake clamping elements into engagement with the snake to preclude axial displacement of the snake relative to the guide tube and housing, whereby the operator can forcibly displace the apparatus and thus the snake axially relative to the drain pipe into which the snake extends.

Hand held, motor driven drain cleaners of the foregoing character have also been provided with arrangements for axially feeding and retracting the snake relative to the drum in response to rotation of the snake as shown, for example, in U.S. Pat. Nos. 3,224,024 to Hunt and 5,029,356 to Silverman, et al. In the patent to Hunt, the front end of the drain cleaning apparatus is provided with an attachment comprising a pair of helically grooved feed rolls against which the snake is pressed by an actuator block or actuator rolls displaced by a pivotal lever. Engagement of the rotating snake with the helical rolls results in axial displacement of the snake relative to the device. In the patent to Silverman, et al., the drive arrangement comprises a plurality of rolls spaced apart about the snake and having axes which are skewed relative to the snake axis and wherein the rolls are cammed radially inwardly to engage with the rotating snake to achieve axial feeding thereof relative to the device. Other snake feeding devices used in connection with power driven drain cleaners which, while portable, are not of the hand held type, are shown for example in U.S. Pat. Nos. 4,580,306 to Irwin, 5,031,263 to Babb, et al. and 5,239,724 to Salecker, et al.

In all of the feed control arrangements heretofore available for use in connection with power driven drain cleaning apparatus, including those specifically referenced above, the control arrangements are structurally complex, difficult to access with respect to cleaning and/or performing maintenance and replacement operations with respect to parts thereof, and require time-consuming adjustments or disassembly operations in connection with the initial feeding of the enlarged auger contoured end of the snake or an auger or blade attachment thereon through the feed device. In this respect, for example, the feed rolls are enclosed in a housing and cannot be accessed for cleaning, maintenance or replacement without at least partial disassembly of the housing, or removal of the rolls, whereby access in any event requires considerable time and effort. In all of the arrangements in which the feed rolls are radially adjustable relative to an opening through the housing which receives the snake, the supporting structures are complex, adjustment is time-consuming and displacement of the rolls radially outwardly of the opening to accommodate withdrawal or insertion of the auger tip of a snake is time-consuming, especially if it is necessary to remove one of the feed rolls. With regard in particular to a hand held drain cleaning device of the character disclosed in the patent to Hunt referred to above, the location and disposition of the lever makes it difficult to achieve stability with respect to holding the drain cleaner and operating the lever to apply sufficient force on the snake to achieve feeding thereof, especially when an obstruction is encountered in the drain line.

SUMMARY OF THE INVENTION

A feed control device as provided in accordance with the present invention which is comprised of a minimum number of parts of simple structure and which are structurally interrelated so as to provide a snake feeding device in which the foregoing and other problems and disadvantages encountered with such devices heretofore available are minimized or overcome. Basically, the device comprises a housing having a passage therethrough for receiving a rotatable snake, and feeding of the snake axially of the housing is achieved by drive rolls supported on the housing, a drive actuating arrangement for displacing the rotating snake against the drive rolls, and a lever pivotally mounted on the housing for displacing the drive actuating arrangement against the snake. In accordance with one aspect of the invention, the drive actuating arrangement has radially inner and outer ends relative to the axis of the housing and is constructed for selectively varying the distance between the inner and outer ends, thus enabling adjustment of the feed device to accommodate a variety of different snake diameters without having to provide for radial adjustment of the snake drive rolls which, preferably, are mounted on the housing for rotation about axes which are fixed relative thereto.

In accordance with another aspect of the invention, the drive actuating arrangement is removably mounted on the housing and has a radially outer end interengaging with the pivotal lever for the latter to releasably hold the drive actuating arrangement in its mounted position. The interengagement provides for a quick release of the lever from the drive actuating arrangement, and removal of the latter from the housing optimizes the area of the passage therethrough transverse to the snake, whereby the enlarged auger contour or attachment on the free end of the snake is readily feedable through the housing.

In accordance with yet another aspect of the invention, the adjustment of the radial length between the inner and outer ends of the drive actuating arrangement is achieved by threadedly interengaged radially inner and outer members, the outer member of which is provided with an operating knob providing the outer end of the actuating arrangement. The pivotal lever has a latch component which frictionally interengages with the peripheral edge of the operating knob, thus to both releasably hold the drive actuating arrangement on the housing and restrain rotation of the knob so as to maintain the drive actuating arrangement in a desired adjusted position with respect to the distance between the inner and outer ends thereof.

In accordance with still a further aspect of the invention, the housing of the feed device is tubular and has a transverse wall therein between the opposite ends of the housing, and the wall has the passage therethrough for receiving a snake. The housing has a front end with respect to the direction of displacement of the snake therethrough and into a drain to be cleaned, and the drive rolls are mounted on the side of the wall facing the front end of the housing and, thus, are readily accessible for cleaning and/or removal for maintenance and/or replacement. Preferably, the drive actuating arrangement includes a drive actuating roll mounted on the inner end of the inner member which is slidably and removably received in a radial bore in the housing opening into the snake passage, whereby all three rolls are readily accessible and removable from the housing. The lever is preferably mounted on the front end of the housing and extends upwardly from the pivot access therefor and then rearwardly across the outer end of the operating knob, and the latch element on the lever is a finger extending downwardly across the peripheral edge of the knob on the rear side thereof with respect to the direction between the front and rear ends of the housing. Accordingly, the feed control device is easily operated by depressing the lever against the outer end of the operating knob to displace the drive actuating roll against the snake, and the lever is adapted to be readily displaced to an unlatched position relative to the operating knob, whereby the latter can be rotated to adjust the length of the drive actuating arrangement or, alternatively, the drive actuating arrangement can be removed from the housing to facilitate feeding or removing of the enlarged free end of the snake therethrough and/or maintenance with respect to the drive actuating arrangement.

Preferably, the rear end of the housing is contoured for attachment to the outer end of the hand grip sleeve of a hand held power driven drain cleaning apparatus such as that shown in U.S. Pat. No. 4,956,889 to Kirk referred to hereinabove, whereby it will be appreciated that the housing and lever readily accommodate the operator holding the front end of the drain cleaning apparatus in his or her fingers and operating the lever with the thumb of the same hand. Further in connection with the Kirk apparatus, the latter accommodates a replaceable snake cartridge, and the quick release of the drive actuating unit in the snake feeding device of the present invention advantageously minimizes the time and effort required to change snake cartridges by allowing the passage of the enlarged tip end of a snake therethrough.

It is accordingly an outstanding object of the present invention to provide an improved feed control device for axially feeding a snake in motor driven drain cleaning apparatus.

Another object is the provision of a snake feed control device of the foregoing character which comprises snake driving rolls and a drive actuating arrangement for displacing the snake against the driving rolls through the use of a pivotal lever and wherein the drive actuating arrangement is selectively adjustable for the device to accommodate snakes having different diameters.

A further object is the provision of a feed control device of the foregoing character in which the drive actuating arrangement is removably mounted on the housing and releasably retained therein by interengagement with the lever.

Still another object is the provision of a feed control device of the foregoing character in which the drive actuating arrangement and the lever interengage to maintain the drive actuating arrangement in a selected position of adjustment.

Yet a further object is the provision of a feed control device of the foregoing character in which the drive actuating arrangement is readily separable from the housing to facilitate the feeding and/or removal of an enlarged auger shaped or other tip end of the snake through the housing.

Yet a further object is the provision of a feed control device of the foregoing character in which the snake driving rolls and drive component of the drive actuating arrangement are readily accessible and removable from the housing in connection with the performance of maintenance and/or replacement operations with respect thereto.

Another object is the provision of a feed control device of the foregoing character which is comprised of a minimum number of parts structured and structurally interrelated to provide a compact feed control device which is efficient in operation, which minimizes the time required to achieve adjustment thereof to accommodate different sized snakes, minimizes the time required to feed or retract an enlarged tip end of a snake therethrough, and in which the component parts are more readily accessible for maintenance and/or replacement then heretofore possible.

Still another object is the provision of a feed control device of the foregoing character which is adapted to be mounted as an attachment on the front end of hand held, motor driven drain cleaning apparatus and which when so mounted facilitates an operator supporting the front end of the apparatus by the fingers of a hand and displacing the operating lever of the feed device by the thumb of the same hand to achieve axial displacement of the snake.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
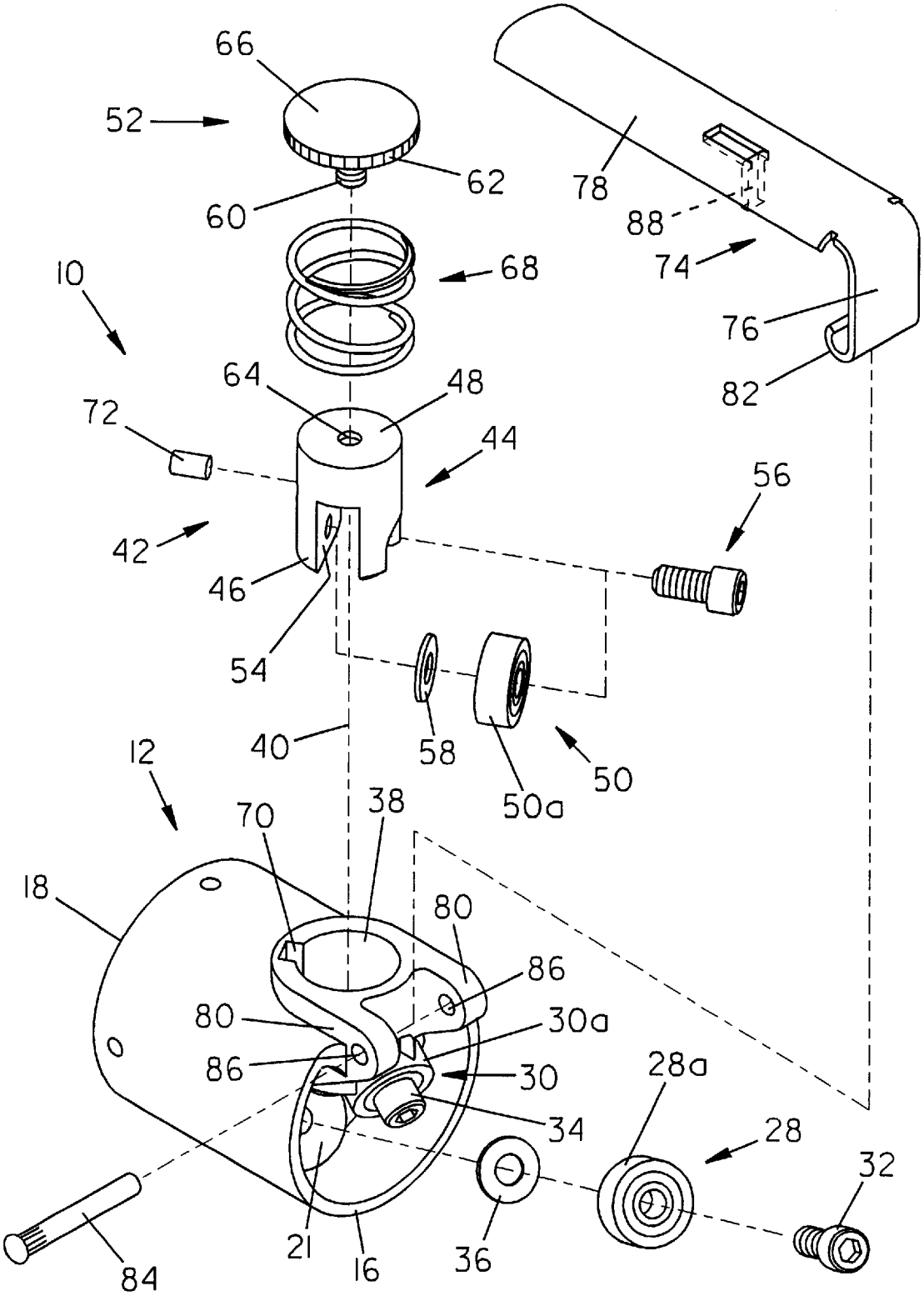
FIG. 1 is a perspective exploded view of a feed control device in accordance with the present invention.

Referring now in greater detail to the drawings wherein the showings are for the purpose of illustrating a preferred embodiment of the invention only and not for the purpose of limiting the invention, a snake feed control device 10 in accordance with the present invention comprises a tubular housing 12 having an axis 14 and axially opposite front and rear ends 16 and 18, respectively. Housing 12 includes a wall 20 therein between ends 16 and 18 and transverse to axis 14, and wall 20 has front and rear sides not designated numerically, respectively facing front end 16 and rear end 18 of the housing. Wall 20 includes a passage 22 for receiving a snake 24 which is adapted to be axially fed relative to the device in the manner described in greater detail hereinafter. As is conventional, snake 24 is made of tightly wound spring wire and, in the embodiment illustrated, the wire at the free or outer end thereof is formed to provide an auger tip 26 which is radially enlarged relative to the remainder of the snake. Wall 20 includes roll mounting nodes 21 on the front side thereof, and feed device 10 further includes a pair of snake driving rolls 28 and 30 mounted on nodes 21 by socket head cap screws 32 and 34, respectively. Preferably a washer is interposed between each roll and the corresponding node as will be appreciated from the washer 36 illustrated in FIG. 1 in connection with roll 28. Cap screws 32 and 34 provide axes of rotation for driving rolls 28 and 30, respectively, and each driving roll axis is skewed both horizontally and vertically relative to housing axis 14 and, preferably, at an angle of 30° with respect to each direction. It will be appreciated that the outer faces of nodes 21 are perpendicular to the corresponding driving roll axis. Driving rolls 28 and 30 have smooth outer surfaces 28*a* and 30*a*, respectively, and the skewed mounting thereof provides for driving snake 24 in a well known manner when the snake is rotated and displaced against the driving rolls.

Figure 2:
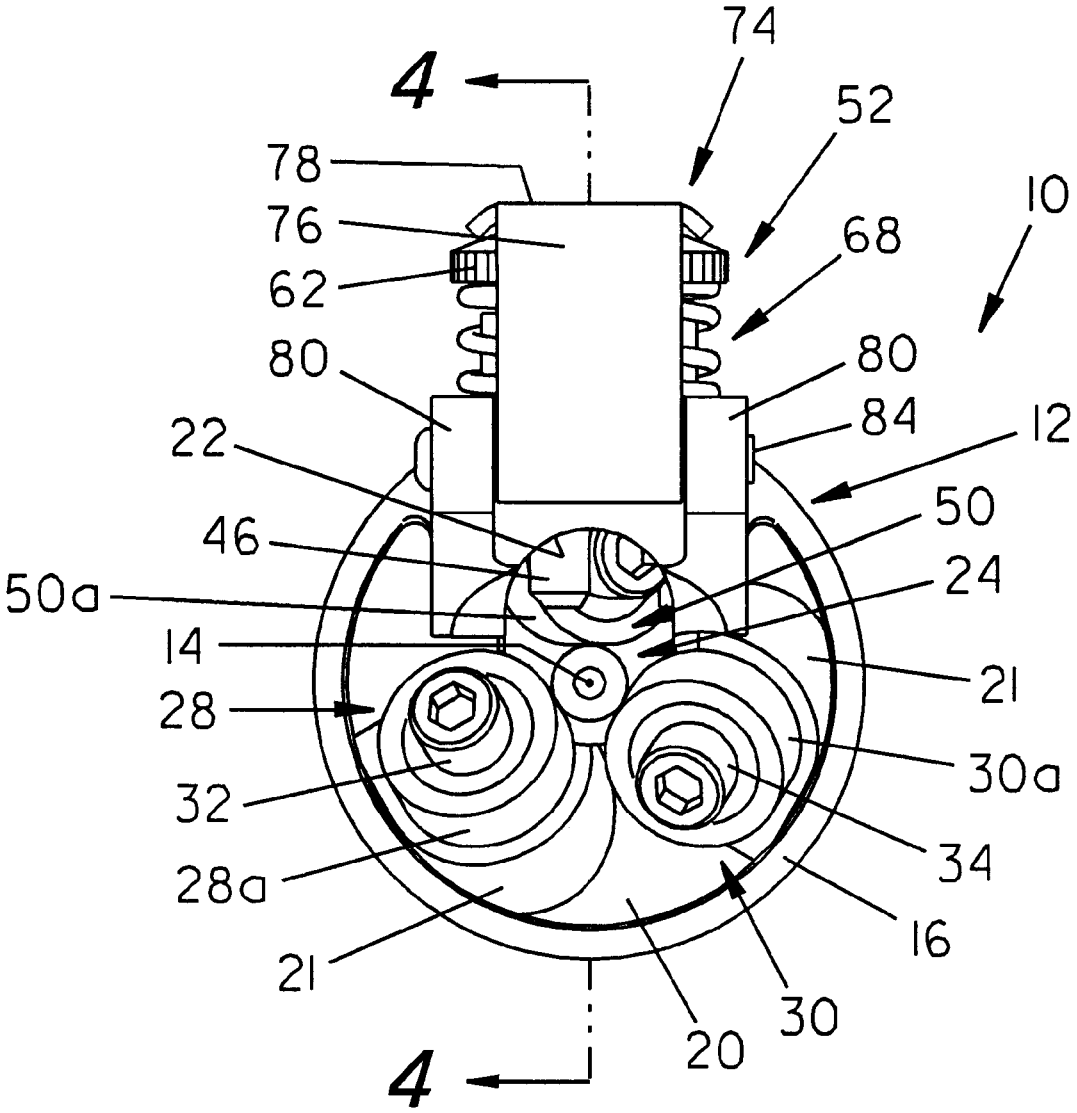
FIG. 2 is a front elevation view of the device.

Housing 12 is provided inwardly adjacent front end 16 with a radially extending bore 38 having a bore axis 40 and an axially inner end which opens into snake passage 22. A snake drive actuating unit 42 is slidably and removably received in bore 38 and includes a drive actuating roll support member 44 having radially inner and outer ends 46 and 48, respectively, a drive actuating roll 50 mounted on inner end 46, and an operating member 52 mounted on outer end 48. More particularly, inner end 46 of roll support member 44 is provided with an axially extending recess 54 receiving drive actuating roll 50 which is mounted in recess 54 by means of a socket head cap screw 56 and a washer 58, whereby roll 50 is rotatable about a drive actuating roll axis provided by cap screw 56. Operating member 52 includes a threaded stem 60 and an operating knob on the outer end thereof and having a peripheral edge 62 coaxial with axis 40 and having axially extending serrations or rolls, not designated numerically. Outer end 48 of roll support member 44 is provided with a threaded bore 64 which rotatably receives threaded stem 60, whereby the axial length of drive actuating unit 42 is adjustable by rotating operating member 52 relative to roll support member 44. The operating knob of member 52 has an axially outer surface 66 which is axially outwardly curved with respect to bore axis 40 and provides the outer end of drive actuating unit 42. The radially innermost end of drive actuating roll 50 provides the radially inner end of the drive actuating unit, and when the latter is received in bore 38, a compression spring 68 surrounds roll support member 44 and engages between the outer surface of housing 12 and the underside of the knob of operating member 52 to bias the drive actuating unit radially outwardly relative to the axis of housing 12. Drive actuating roll 50 is supported in housing 12 for the axis thereof to be skewed horizontally with respect to the housing axis, preferably at an angle of 30° relative thereto. For this purpose, an axially extending guide slot 70 is provided along bore 38 for receiving the outer end of a roll pin 72 which is mounted in an opening provided therefor in roll support member 44, not shown. Roll 50 has a smooth outer surface 50*a* and, as will be appreciated from FIG. 2, snake driving rolls 28 and 30 and actuator drive roll 50 are equally spaced apart circumferentially about housing axis 14.

Figure 5:
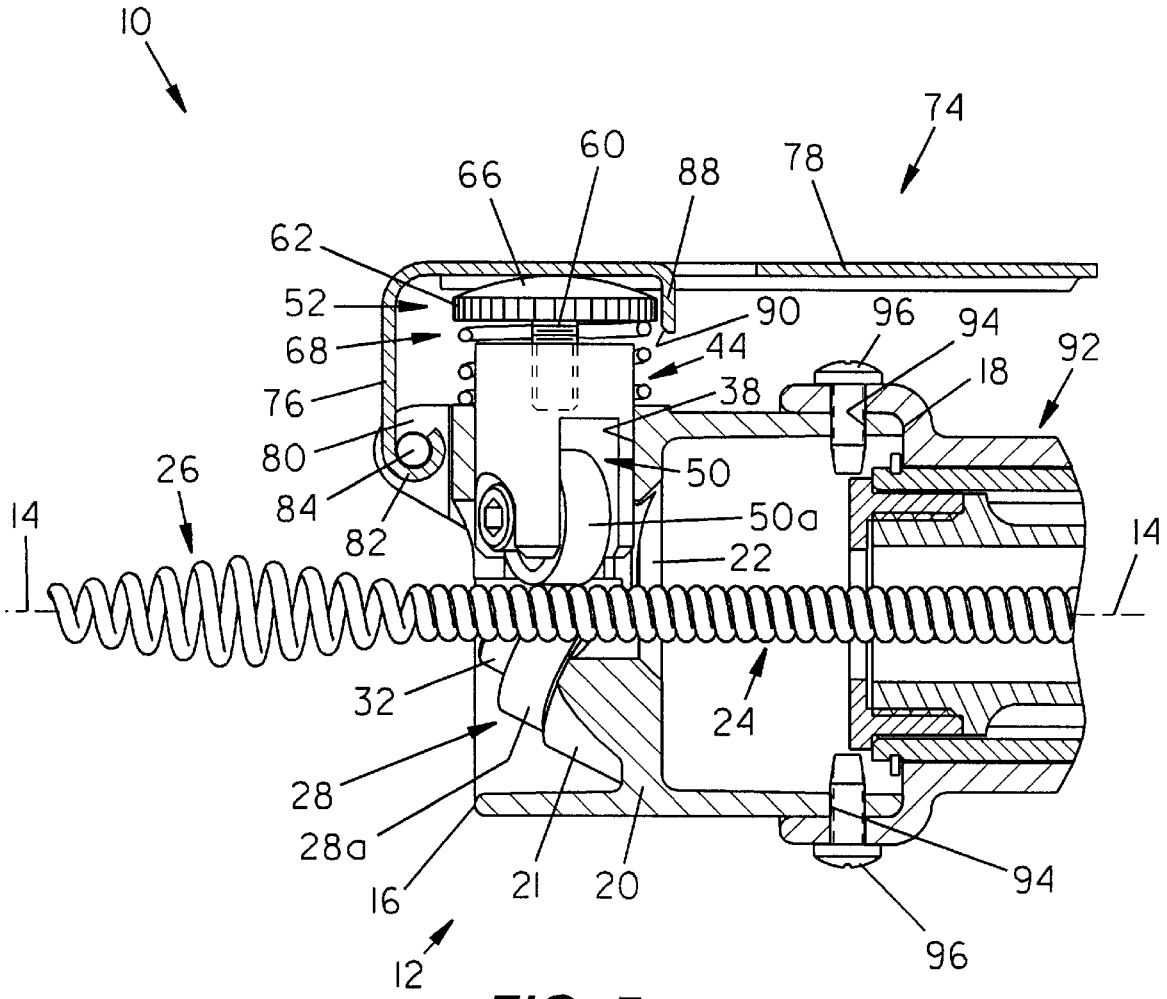
FIG. 5 is a sectional elevation view similar to FIG. 4 and showing the drive actuating unit in operative engagement with the snake; and, FIG. 6 is a sectional elevation view similar to FIG. 4 and showing the lever in an unlatched position relative to the operating knob.
Figure 6:
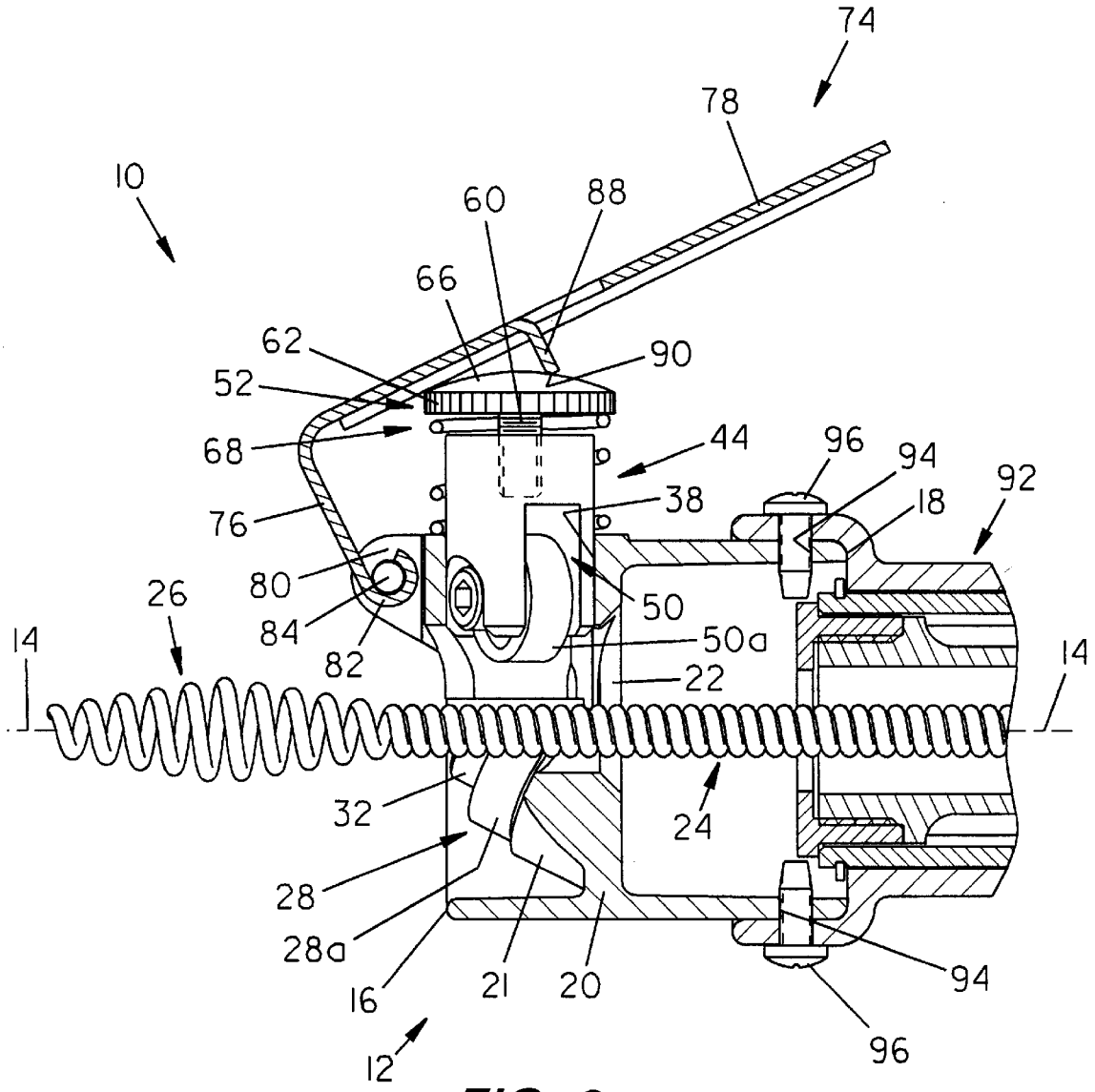

Drive actuating unit 42 is adapted to be displaced radially inwardly of housing 12 against the bias of spring 68 by means of an operating lever 74 which includes a mounting leg 76 and a handle portion 78 extending generally perpendicular to the mounting leg. Front end 16 of housing 12 is provided with a pair of lever mounting ears 80 extending axially outwardly from end 16 at the radially outer end of bore 38, and mounting leg 76 is received between ears 80 for a rolled tubular lower end portion 82 thereof to receive a pivot pin 84 which extends through openings 86 provided therefor in ears 80. Pin 84 provides a lever pivot axis transverse to and laterally spaced from both housing axis 14 and bore axis 40 and, as best seen in FIGS. 4–6, handle portion 78 of the lever normally extends across outer surface 66 of the operating knob of operating member 52 and slightly outwardly beyond rear end 18 of housing 12.

Figure 4:
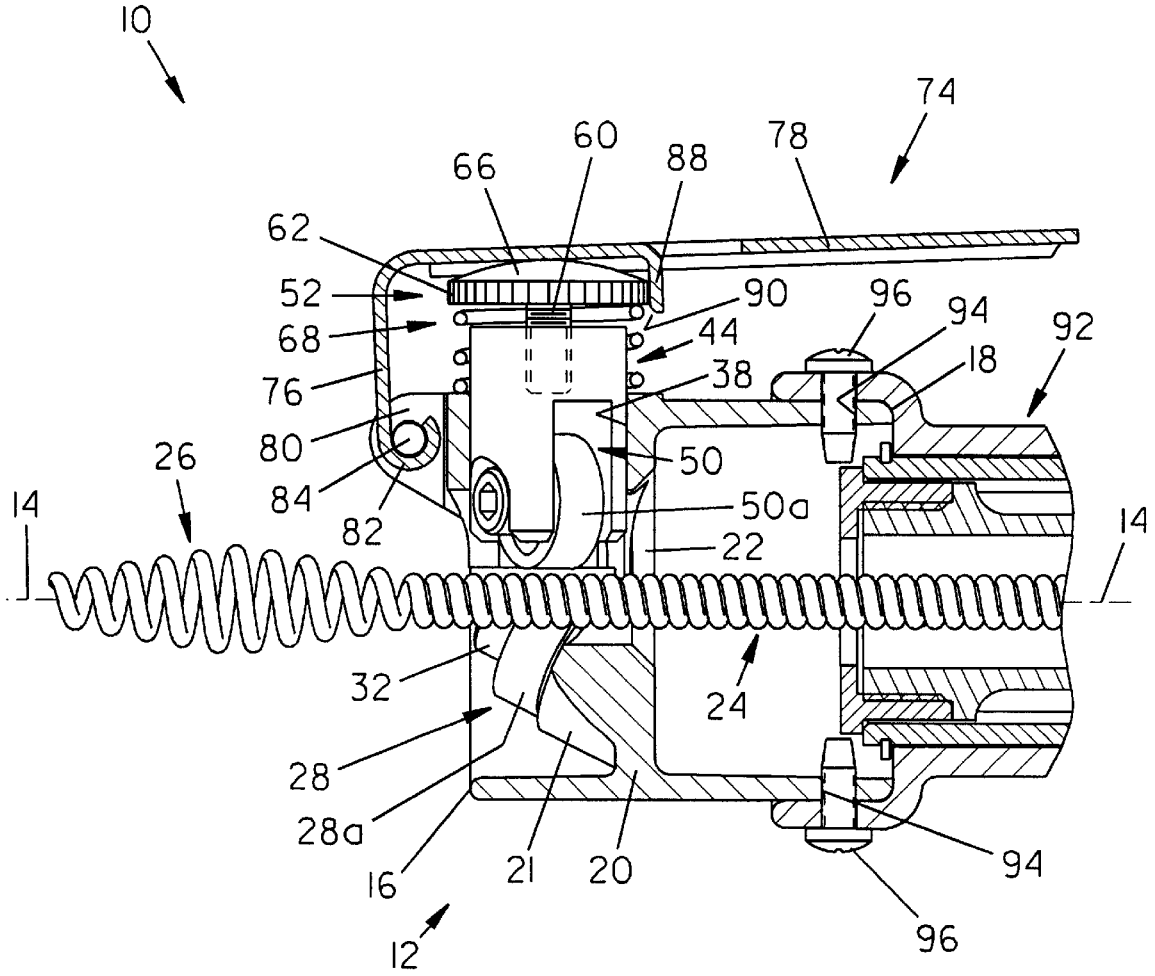
FIG. 4 is a sectional elevation view taken along line 4—4 in FIG. 2 and showing a snake extending through the device and the lever latched to the operating knob of the drive actuating unit.

With reference now in particular to FIGS. 1 and 4 of the drawing, handle portion 78 of lever 74 is provided with a latch element in the form of a finger 88 having a beveled outer end 90 for the purpose set forth hereinafter. Finger 88 is struck from the material of the handle portion to extend downwardly generally perpendicular thereto and, when lever 74 is in the position shown in FIG. 4, finger 88 frictionally interengages with peripheral edge 62 of operating knob 52, whereby drive actuating unit 42 is releasably held in bore 38 by lever 74. In the position of the feed device shown in FIG. 4, drive actuating roll 50 is out of engagement with snake 24, and spring 68 biases lever 74 counterclockwise about pivot pin 84 so as to engage finger 88 radially inwardly against peripheral edge 62 of the operating knob. By depressing handle portion 78 of lever 74 toward housing 12, the lever is pivoted clockwise about pin 84 to the position shown in FIG. 5 in which drive actuating roll 50 engages snake 24 for the latter to be axially fed as will be described in greater detail hereinafter. Such displacement of lever 74 presses handle portion 78 against outer surface 66 of the operating knob of member 52, whereby drive actuating unit 42 is displaced axially inwardly of bore 38 against the bias of spring 68 and finger 88 is displaced radially outwardly of peripheral edge 62. Upon release of lever 74 from the position shown in FIG. 5, spring 68 biases operating member 52 radially outwardly of housing 12 to pivot lever 74 counterclockwise about pin 84, whereby finger 88 again frictionally interengages with peripheral edge 62 of the operating knob as shown in FIG. 4 to releasably hold drive actuating unit 42 in bore 38.

Figure 3:
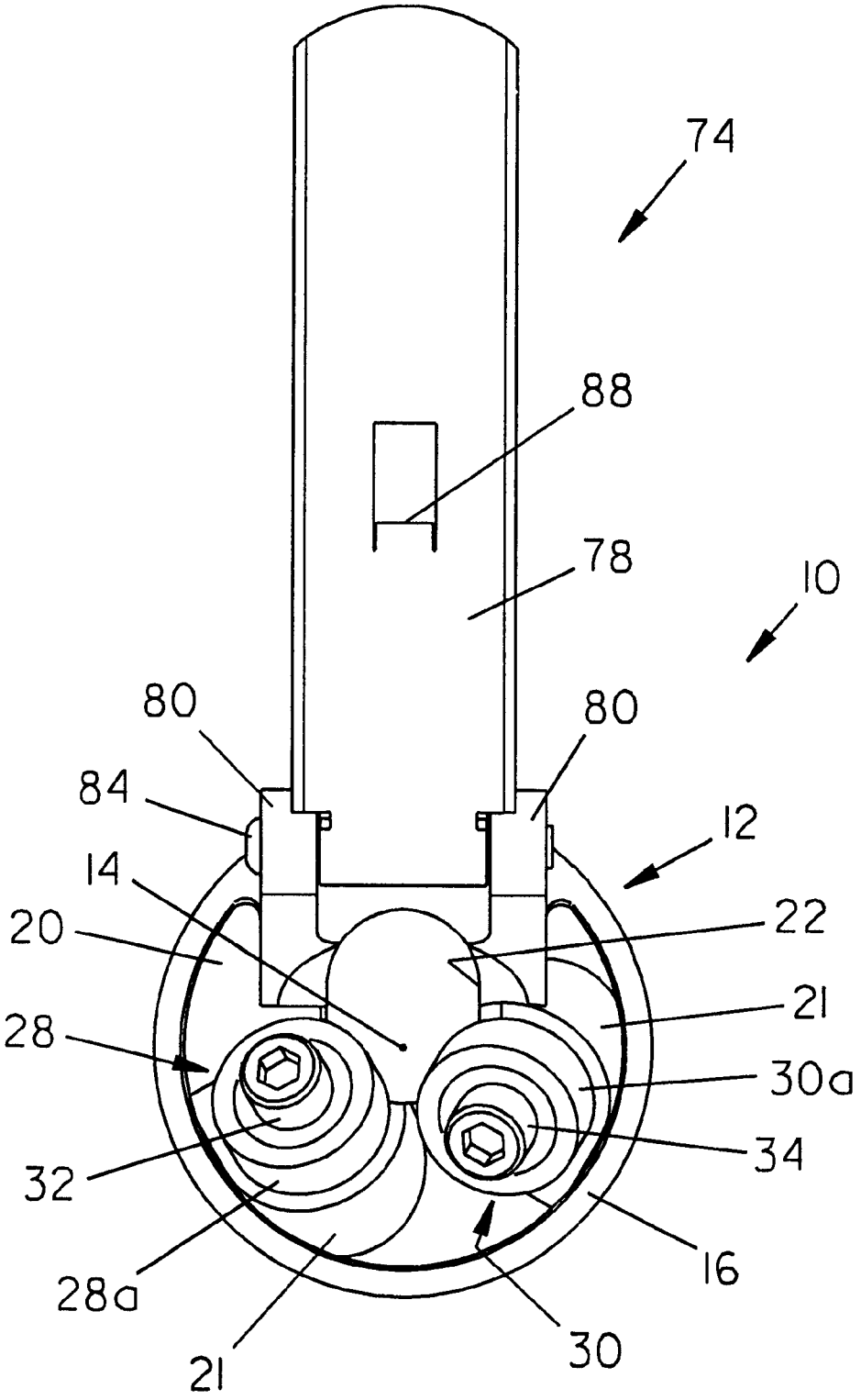
FIG. 3 is a front elevation view of the device with the drive actuating unit removed and the lever in position for such removal.

As mentioned hereinabove, operating member 52 is rotatable relative to roll support member 44 so as to enable adjustment of the axial length of the drive actuating unit as defined by the innermost end of roll 50 and the outermost point on surface 66. Finger 88 on handle portion 78 of the lever in frictionally engaging peripheral edge 62 of the operating knob of member 52 restrains rotation thereof relative to roll support member 44 so as to preclude an unintended change in the length of the drive actuating unit. When it is desired to adjust the length of the drive actuating unit and/or to remove the latter from housing 12 for maintenance and/or replacement purposes or to facilitate the feed or removal of auger portion 26 of snake 24 from housing 12, lever 74 is pivoted counterclockwise from the position shown in FIG. 4 to disengage finger 88 from peripheral edge 62. When the finger disengages from edge 62, spring 68 biases the drive actuating unit radially outwardly of housing 12 to the position shown in FIG. 6 in which finger 88 engages outer surface 66 of the operating knob radially inwardly of peripheral edge 62 thereof. In the latter position, the operating knob can be freely rotated to adjust the length of the drive actuating unit, or the lever can be further pivoted counterclockwise to a position in which handle portion 78 is laterally offset from bore axis 40 and extends generally vertically relative to housing 12, as shown in FIG. 3. In the latter position, drive actuating unit 42 is readily removable from bore 38 whereby, as will be appreciated from FIG. 3, drive actuating roll 50 is displaced from its position intersecting snake passage 22. Accordingly, the latter can accommodate the enlarged auger portion 26 of snake 24 to facilitate the insertion or removal thereof from housing 12. When the component parts are in the positions shown in FIG. 6, lever 74 is adapted to be pivoted clockwise about pin 84 whereupon beveled outer end 90 of finger 88 interengages with outer surface 66 of the operating knob to displace drive actuating unit 42 radially inwardly of housing 12. During such displacement of the drain actuating unit, finger 88 slides radially outwardly along surface 66 towards peripheral edge 62 of the operating knob. When beveled end 90 of finger 88 moves across the upper extremity of peripheral edge 62, finger 88 moves downwardly and axially across edge 62 to again frictionally interengage the lever and operating knob to releasably hold the drive actuating unit in housing bore 38.

Referring again to FIGS. 4–6, feed control device 10 in accordance with the present invention is adapted to be attached to the axially outer end of a hand grip sleeve assembly 92 which corresponds structurally and functionally to hand grip sleeve assembly 60 in the drain cleaning apparatus disclosed in U.S. Pat. No. 4,956,889 to Kirk incorporated herein by reference. More particularly in this respect, rear end 18 of housing 12 is provided with diametrically opposed pairs of threaded openings 94 adapted to be aligned with corresponding openings provided in the outer end of sleeve assembly 92 for receiving threaded fasteners 96 by which feed control unit 10 is removably mountable on sleeve assembly 92. As will be appreciated from the disclosure of Kirk, operation of the motor unit therein causes the snake extending through the hand grip sleeve assembly, which is held by the operator, to rotate relative to the hand grip assembly. The component parts of feed device 10 are initially in the positions thereof shown in FIG. 4, whereby rotation of snake 24 is relative to housing 12. There is no axial displacement of the snake at this time in that actuating drive roll 50 is disengaged from snake 24. When lever 74 is displaced clockwise from the position shown in FIG. 4 to the position shown in FIG. 5, however, drive actuator roll 50 is displaced radially inwardly against snake 24 to displace the latter against driving rolls 28 and 30 which, as a result of the skewed disposition thereof, interengage with the rotating snake to cause the latter to advance axially of housing 12 in the direction relative to the housing which depends on the direction of rotation of the snake. In this respect, rotation of the snake in one direction advances the latter axially outwardly from front end 16 of the housing while rotation of the snake in the opposite direction draws the snake axially inwardly of the housing. When it is desired to stop axial displacement of the snake, lever 74 is released for spring 68 to return drive actuating unit 42 to the position thereof shown in FIG. 4 in which roll 50 disengages from snake 24.

While considerable emphasis has been placed herein on the structures and structural interrelationships between the component parts of a preferred embodiment of the invention, it will be appreciated that other embodiments of the invention can be made and that many changes can be made in the preferred embodiment without departing from the principles of the invention. In this respect, for example, the snake driving rolls could be mounted on the housing for rotation about axes parallel to the housing axis and provided with helically grooved outer surfaces for cooperative engagement with the helically wound wire of the snake to achieve axial displacement of the latter relative to the housing upon displacement of the snake thereagainst. Likewise, wall 20 can be axially thickened and provided with recesses for the snake driving rolls in place of the nodes which extend axially forwardly of the wall in the embodiment shown herein. Further, while it is preferred to provide a roll element for displacing the snake against the snake driving rolls, it will be appreciated that such displacement could be achieved by a suitable pad member on the inner end of the support member of the drive actuating unit. Still further, it will be appreciated that arrangements other than threaded interengagement between the roll support member 44 and operating member 52 can be provided for achieving adjustment of the length of the drive actuating unit. Still further, the housing can be structured for support relative to the rotating snake of drain cleaning apparatus other than by mounting on the outer end of the hand grip assembly of a hand held power driven drain cleaning apparatus as disclosed herein. The foregoing and other modifications of the preferred embodiment as well as other embodiments of the invention will be suggested and obvious to those skilled in the art from the preferred embodiment disclosed herein, whereby it is to be distinctly understood that the foregoing descriptive matter is to be interpreted merely as illustrative of the present invention and not as a limitation.

Having thus described the invention, it is so claimed:

1. A feed control device for use with a plumbing tool including an elongate flexible snake having a snake axis, and means for rotating the snake about said axis, comprising: a housing having a housing axis and a passage axially therethrough for receiving said snake, snake driving roll means supported on said housing, drive actuating means supported on said housing for radially displacing said snake against said snake driving roll means, said drive actuating means having radially inner and outer ends and including means independent of said housing for adjusting the distance between said ends, and lever means pivotally mounted on said housing for engaging said outer end and radially displacing said drive actuating means against said snake.

2. A device according to claim 1, wherein said snake driving roll means includes a pair of snake driving rolls each mounted on said housing for rotation about a drive roll axis radially fixed relative to said passage.

3. A device according to claim 2, wherein each drive roll axis is skewed relative to said housing axis.

4. A device according to claim 3, wherein each of said snake driving rolls has a smooth outer surface.

5. A device according to claim 2, wherein said drive actuating means includes a drive actuating roll providing said inner end thereof and rotatable about an actuating roll axis.

6. A device according to claim 5, wherein each said drive roll axis and said actuating roll axis is skewed relative to said housing axis and each of said snake driving rolls and said actuating roll has a smooth outer surface.

7. A device according to claim 1, wherein said drive actuating means includes first and second members, and means interconnecting said first and second members for displacement relative to one another for adjusting the distance between said inner and outer ends.

8. A device according to claim 7, wherein said means interconnecting said first and second members includes thread means.

9. A device according to claim 8, wherein said first member includes a threaded bore and said second member includes a threaded stem rotatably received in said threaded bore.

10. A device according to claim 1, further including means for biasing said drive actuating means radially outwardly of said passage, said lever means and said outer end of said drive actuating means including means interengaging to limit radial outward movement of said drive actuating means, said drive actuating means being removably mounted on said housing, and said means interengaging to limit radial outward movement including releasably interengaging means for releasing said drive actuating means for removal from said housing.

11. A feed control device for use with a plumbing tool including an elongate flexible snake having a snake axis, and means for rotating the snake about said axis, comprising: a housing having a housing axis and a passage axially therethrough for receiving said snake, snake driving roll means supported on said housing drive actuating means supported on said housing for radially displacing said snake against said snake driving roll means, said drive actuating means having radially inner and outer ends and including means for adjusting the distance between said ends, and lever means pivotally mounted on said housing for engaging said outer end and radially displacing said drive actuating means against said snake, and means for biasing said drive actuating means radially outwardly of said passage.

12. A device according to claim 11, wherein said lever means and said outer end of said drive actuating means include means interengaging to limit radial outward movement of said drive actuating means.

13. A feed control device for use with a plumbing tool including an elongate flexible snake having a snake axis, and means for rotating the snake about said axis, comprising: a housing having a housing axis and a passage axially therethrough for receiving said snake, snake driving roll means supported on said housing, drive actuating means supported on said housing for radially displacing said snake against said snake driving roll means, said drive actuating means having radially inner and outer ends and including means for adjusting the distance between said ends, and lever means pivotally mounted on said housing for engaging said outer end and radially displacing said drive actuating means against said snake, drive actuating means including first and second members, means interconnecting said first and second members for displacement relative to one another for adjusting the distance between said inner and outer ends, said housing including a radial bore slidably receiving said first member, and spring means between said housing and said second member for biasing said drive actuating means radially outwardly of said radial bore.

14. A device according to claim 13, wherein said second member and said lever means include means interengaging to limit radial outward displacement of said drive actuating means.

15. A device according to claim 14, wherein said means interconnecting said first and second members includes a threaded bore in said first member and a threaded stem on said second member rotatably received in said radial bore, said stem having a knob therein for rotating said second member relative to said first member, said knob providing said outer end of said drive actuating means.

16. A device according to claim 15, wherein said lever means includes means interengaging with said knob to limit radial outward displacement of said drive actuating means.

17. A device according to claim 16, wherein said means interengaging with said knob releasably interengages therewith to release said drive actuating means for removal from said radial bore.

18. A device according to claim 14, wherein said means interengaging said second member and said lever means includes means on said lever means releasably interengaging with said second member for releasing said drive actuating means for removal from said radial bore.

19. A device according to claim 13, wherein said inner end of said drive actuating means includes a drive actuating roll mounted on said first member for rotation about an actuating roll axis.

20. A device according to claim 19, wherein said snake driving roll means includes a pair of snake driving rolls each mounted on said housing for rotation about a drive roll axis radially fixed relative to said opening.

21. A device according to claim 20, wherein each said drive roll axis and said actuating roll axis is skewed relative to said housing axis and each of said snake driving rolls and said actuating roll has a smooth outer surface.

22. A device according to claim 21, wherein said means interconnecting said first and second members includes a threaded bore in said first member and a threaded stem on said second member rotatably received in said bore, said stem having a knob therein for rotating said second member relative to said first member, said knob providing said outer end of said drive actuating means.

23. A device according to claim 22, wherein said knob has a peripheral edge and said lever includes a finger releasably interengaging with said edge to limit radial outward displacement of said drive actuating means and to release said drive actuating means for removal from said radial bore.

24. A feed control device for use with a plumbing tool including an elongate flexible snake having a snake axis, and means for rotating the snake about said axis, comprising: a housing having a housing axis and a passage axially therethrough for receiving said snake, snake driving roll means supported on said housing, radially displaceable drive actuating means removably supported on said housing for displacing said snake against said snake driving roll means, said drive actuating means having a radially outer end, a lever pivotally mounted on said housing for engaging said outer end and radially displacing said drive actuating means against said snake, and said lever and said outer end including means interengaging for said lever to releasably hold said drive actuating means on said housing against removal therefrom.

25. A feed control device for use with a plumbing tool including an elongate flexible snake having a snake axis and means for rotating the snake about said axis, comprising: a housing having a housing axis and a passage axially therethrough for receiving said snake, snake driving roll means supported on said housing, radially displaceable drive actuating means removably supported on said housing for displacing said snake against said snake driving roll means, said drive actuating means having a radially outer end, a lever pivotally mounted on said housing for engaging said outer end and radially displacing said drive actuating means against said snake, and said lever and said outer end including means interengaging for said lever to releasably hold said drive actuating means on said housing, said means interengaging to releasably hold said drive actuating means including latch means on said lever frictionally engaging said outer end of said drive actuating means.

26. A device according to claim 25, further including spring means biasing said drive actuating means radially outwardly of said housing for said outer end to engage against said lever.

27. A device according to claim 26, wherein said outer end includes an operating member transverse to the direction of radial displacement of said drive actuating means and having a peripheral edge, said latch means engaging against said peripheral edge.

28. A device according to claim 27, wherein said latch means includes a finger on said lever extending therefrom generally in said direction.

29. A device according to claim 28, wherein said operating member has a radially outer surface relative to said housing axis, said surface being bounded by said peripheral edge, and said lever having latched and unlatched positions in which said finger respectively frictionally engages against said peripheral edge and overlies said outer surface inwardly of said edge.

30. A device according to claim 29, wherein said outer surface has a curvature radially outwardly relative to said housing axis and said finger has an end engaging said surface in said unlatched position, whereby said finger upon displacement of said lever from the unlatched toward the latched position displaces said drive actuating means radially inwardly of said housing and said end of said finger moves radially outwardly along said surface toward said peripheral edge.

31. A device according to claim 30, wherein said end of said finger is provided with an edge for sliding engagement with said outer surface and cam surface means for sliding engagement across the intersection of said peripheral edge with said outer surface.

32. A feed control device for use with a pluming tool including an elongate flexible snake having a snake axis, and means for rotating the snake about said axis, comprising: a housing having a housing axis and a passage axially therethrough for receiving said snake, snake driving roll means supported on said housing, radially displaceable drive actuating means removably supported on said housing for displacing said snake against said snake driving roll means, said drive actuating means having a radially outer end, a lever pivotally mounted on said housing for engaging said outer end and radially displacing said drive actuating means against said snake, said lever and said outer end including means interengaging for said lever to releasably hold said drive actuating means on said housing, said housing including a radial bore slidably receiving said drive actuating means, said lever having a first position extending across said bore, and a second position laterally outwardly of said bore and in which said drive actuating means is freely slidable out of said bore, and said means interengaging for said lever to releasably hold said drive actuating means including latch means on said lever frictionally engaging said outer end of said drive actuating means in said first position of said lever.

33. A device according to claim 32, wherein said outer end includes an operating member transverse to the direction of radial displacement of said drive actuating means and having a peripheral edge and said latch means including a finger on said lever engaging against said peripheral edge in said first position of said lever.

34. A device according to claim 33, further including a biasing spring biasing said drive actuating means radially outwardly of said bore, said operating member having an outer surface, and said lever having a third position between said first and second positions in which said finger engages against said outer surface of said operating member radially inwardly of said peripheral edge, whereby said finger upon displacement of said lever from said third toward said first position slides radially outwardly along said outer surface and displaces said drive actuating means radially inwardly of said bore against the bias of said spring.

35. A device according to claim 34, wherein said finger has an end engaging said outer surface in said third position of said lever, said end of said finger and said outer surface having profiles for promoting radial outward sliding of said finger from said third to said first position.

36. A device according to claim 35, wherein said outer surface is curved outwardly relative to said housing axis and said end of said finger includes an edge for sliding engagement with said outer surface and a cam surface for sliding engagement across the intersection of said outer surface and said peripheral edge.

37. A device according to claim 36, wherein said snake driving roll means includes a pair of snake driving rolls each mounted on said housing for rotation about a drive roll axis and wherein said drive actuating means includes a drive actuating roll providing said inner end thereof and rotatable about an actuating roll axis.

38. A device according to claim 37, wherein each said drive roll axis and said actuating roll axis is skewed relative to said housing axis and each of said snake driving rolls and said actuating roll has a smooth outer surface.

39. A feed control device for use with a plumbing tool including an elongate flexible snake having an axis, and means for rotating the snake about said axis, comprising: a tubular housing having a housing axis and axially opposite ends, a wall in said housing between said ends, a passage axially through said wall for receiving said snake, a pair of snake driving rolls each supported on said wall for rotation about a corresponding drive roll axis and having a peripheral surface intersecting said passage, a radial bore in said housing having a bore axis and an inner end opening into said passage, a drive actuating unit slidably received in said bore and having radially inner and outer ends, a drive actuating roll providing said inner end and rotatable about an actuating roll axis, means including a lever for displacing said drive actuating unit radially inwardly and outwardly of said passage for said drive actuating roll to respectively engage and disengage said snake against said snake driving rolls, said lever being mounted on said housing adjacent one of said opposite ends for pivotal displacement in opposite directions about a lever axis transverse to and laterally spaced from said bore axis, said lever including a handle portion extending axially of said housing from said one end across said outer end of said actuating unit, whereby displacement of said handle portion radially toward said housing displaces said drive actuating unit radially inwardly of said passage, and said means for displacing said drive actuating unit radially inwardly and outwardly of said passage including spring means for biasing said unit radially outwardly of said passage.

40. A device according to claim 39, wherein each said drive roll axis and said actuating roll axis is skewed relative to said housing axis and each of said snake driving rolls and said drive actuating roll has a smooth outer surface.

41. A device according to claim 39, wherein said drive actuating unit is removably received in said bore and said outer end thereof and said handle portion of said lever include interengaging means for releasably holding said unit in said bore.

42. A device according to claim 39, wherein said drive actuating unit includes means for selectively adjusting the distance between said radially inner and outer ends thereof.

43. A device according to claim 39, wherein said opposite ends of said housing are front and rear ends, said wall having a front side facing said front end, axle shaft means removably mounting said pair of snake driving rolls on said front side of said wall, and said axle shaft means being accessible through said front end of said housing for removal.

44. A device according to claim 39, wherein said drive actuating unit is removably received in said bore and said outer end thereof includes an axially outer surface underlying said handle portion of said lever, said outer surface being bounded by a peripheral edge extending axially with respect to said bore axis, and said handle portion including a latch element and having a latched position in which said latch element frictionally engages with said peripheral edge to releasably interengage said lever and drive actuating unit.

45. A device according to claim 44, wherein said handle portion of said lever is displaceable radially away from said housing to a second position in which said latch element disengages said edge and said handle portion is laterally outwardly of said bore, whereby said drive actuating unit is slidable out of said bore.

46. A device according to claim 45, wherein said latch element is a finger extending from said handle portion.

47. A device according to claim 46, wherein said handle portion of said lever is displaceable to a third position between said latched and second positions, said finger in said third position engaging against said radially outer surface radially inwardly of said edge, and said finger and said outer surface interengaging for displacement of said handle portion radially toward said housing from said third position to displace said actuating unit axially inwardly of said bore and to move said finger radially outwardly and across said peripheral edge to said latched position.

48. A device according to claim 39, wherein said drive actuating unit includes a drive actuating roll support member having radially inner and outer ends and an operating member on said outer end and threadedly interengaged therewith, said drive actuating roll being mounted on said inner end of said support member and said operating member having an outer end including an operating knob providing said outer end of said actuating unit, said operating member being rotatable relative to said support member by said knob to adjust the distance between said inner and outer ends of said actuating unit.

49. A device according to claim 48, wherein said spring means includes a compression spring surrounding said roll support member and having opposite ends engaging one with said housing and the other with said knob.

50. A device according to claim 39, wherein said drive actuating unit is removably received in said bore and includes a drive actuating roll support member having axially inner and outer ends with respect to said bore and an operating member rotatably mounted on said outer end, said drive actuating roll being mounted on said inner end of said support member, said operating member including a knob having an axially outer surface providing said outer end of said drive actuating unit and a peripheral edge coaxial with said bore axis and bounding said surface, said operating member and said outer end of said support member being threadedly interengaged for rotation of said knob to axially adjust the distance between said inner and outer ends of said actuating unit, said handle portion of said lever including a latch element and said lever having first and second positions in which said handle portion respectively overlies said axially outer surface of said knob and is spaced laterally outwardly of said bore, said latch element in said first position frictionally interengaging said peripheral edge to restrain rotation of said knob and to releasably hold said drive actuating unit in said bore, and said handle portion in said second position uncovering said unit for removal from said bore.

51. A device according to claim 50, wherein said latch element is a finger extending axially of said bore when said lever is in said first position, said finger having an end spaced from said handle portion, said lever having a third position between said first and second positions and in which said end of said finger engages said axially outer surface of said knob radially inwardly of said peripheral edge, said end of said finger and said outer surface interengaging for displacement of said lever from said third toward said first position to displace said actuating unit axially inwardly of said bore and said finger radially outwardly along said outer surface and across said peripheral edge.

52. A device according to claim 51, wherein said spring means includes a compression spring surrounding said roll support member and having opposite ends engaging one with said housing and the other with said knob.

53. A device according to claim 52, wherein said opposite ends of said housing are front and rear ends, said wall having a front side facing said front end, axle shaft means removably mounting said pair of snake driving rolls on said front side of said wall, and said axle shaft means being accessible through said front end of said housing for removal.

54. A device according to claim 53, wherein said one of said opposite ends is said front end and said lever includes a leg portion extending generally perpendicular from said handle portion and having an end spaced from said handle portion, said end of said leg portion being pivotally mounted on said front end of said housing to provide said lever axis.

55. A device according to claim 54, wherein each said drive roll axis and said actuating roll axis is skewed relative to said housing axis and each of said snake driving rolls and said drive actuating roll has a smooth outer surface.

* * * * *

UNITED STATES PATENT AND TRADEMARK OFFICE

CERTIFICATE OF CORRECTION

PATENT NO. : 5,901,401

DATED : May 11, 1999

INVENTOR(S) : Michael J. Rutkowski; Jon R. Dunkin

It is certified that error appears in the above-identified patent and that said Letters Patent is hereby corrected as shown below:

Column 3, line 30, delete "access" and insert therefor --axis--.

Column 9, line 55, before "drive" insert --said--.

Column 10, line 2, delete "radial".

Column 10, line 3, delete "therein" and insert therefor --thereon--.

Column 10, line 34, delete "therein" and insert therefor --thereon--.

Signed and Sealed this

Seventh Day of December, 1999

*Attest:*

Q. TODD DICKINSON

*Attesting Officer*

*Acting Commissioner of Patents and Trademarks*